United States Patent [19]

Fleissner

[11] 4,453,461

[45] Jun. 12, 1984

[54] BALING PRESS FOR FIBROUS MATERIALS

[76] Inventor: Gerold Fleissner, Wolfsgartenstr. 6, P.O. Box 1206, 6073 Egelsbach, Fed. Rep. of Germany

[21] Appl. No.: 449,520

[22] Filed: Dec. 13, 1982

[30] Foreign Application Priority Data

Dec. 28, 1981 [DE] Fed. Rep. of Germany ..... 3151672

[51] Int. Cl.[3] ..... B30B 9/30

[52] U.S. Cl. ..... 100/255; 292/66; 292/201

[58] Field of Search ..... 292/201, 64, 66; 100/255, 245, 246, 250

[56] References Cited

U.S. PATENT DOCUMENTS

| | | | |
|---|---|---|---|
| 2,241,063 | 5/1941 | Grimes | 100/255 |
| 3,099,205 | 7/1963 | Lovrinch | 100/255 |
| 3,130,665 | 4/1964 | Neitzel | 100/255 X |
| 3,805,693 | 4/1974 | Neitzel | 100/255 |
| 3,985,072 | 10/1976 | Van Doorn | 100/255 |
| 4,218,081 | 8/1980 | Johnson | 292/66 |

*Primary Examiner*—Billy J. Wilhite

*Attorney, Agent, or Firm*—W. G. Fasse; D. H. Kane, Jr.

[57] ABSTRACT

A baling press for fibrous materials, such as textile fibers, is equipped with a baling box into which a baling ram is movable under hydraulic or pneumatic pressure. The baling box is supported on a base and has hinged walls which are hinged to one another and/or to the base. These hingeable box walls are locked to each other in the box closing position by a piston cylinder locking device in which the piston rod is provided at its free end with a locking member which cooperates with a respective locking element attached to the adjacent wall.

18 Claims, 6 Drawing Figures

BALING PRESS FOR FIBROUS MATERIALS

BACKGROUND OF THE INVENTION

The invention relates to a baling press for fibrous materials such as textile fibers. Such a press comprises at least one baling ram and a press or baling box into which the ram is movable for the baling operation. The walls of the baling box are supported on a support frame and are hinged to one another and/or to the support frame. Additionally, the baling box walls are lockable relative to each other in a box closing position for the baling operation.

Baling presses of the type just mentioned are known in the art in various embodiments. Such presses are used primarily for producing large bales of short or long fibers such as textile fibers. During the pressing or baling operation the fibers are densified in the baling box and pressed with a relatively large force against the walls of the baling box, whereby frequently difficulties have been encountered heretofore in the opening of the locking mechanism. In prior art devices the locking mechanism is under such a high biasing force after the completion of the baling operation that in many instances it is difficult to open the baling box.

OBJECT OF THE INVENTION

In view of the above it is the aim of the invention to achieve the following objects singly or in combination:

- to construct a baling box and its locking mechanism in such a manner that a trouble-free closing and opening of the locking mechanism for the hingeable baling box walls is assured;
- to avoid a jamming of the locking mechanism of a baling box; and
- to provide power driven means for adjusting the instantaneous position of the locking mechanism as well as of the instantaneous position of the hingeable walls or at least one of the walls.

SUMMARY OF THE INVENTION

According to the invention there is provided a baling box of the type described which is characterized in that the box locking mechanism comprises a piston cylinder means which is journalled or hinged to one of the hingeable wall members and which is equipped with a first locking means at the free end of the piston rod which cooperates with a second locking means on another box wall member for power holding the box walls in a closed baling position.

The baling box according to the invention comprises five individual box wall members, whereby first hinging means hinge two box wall members to the base of the structure for movement toward and away from each other and for locating the two wall members opposite each other in the box closing position. Second hinging means hinge a third box wall member to the first mentioned two box wall members. Third hinging means hinge a fourth box wall member to one of the two first mentioned box wall members and a fifth wall member forming a box bottom is supported by a base or frame structure. The locking means are again hinged or journalled to one of the hingeable wall members. The fifth wall member may be a baling ram.

The locking mechanism according to the invention operates in a force locking manner and holds the box wall members to be locked to one another in the locked position solely on the basis of the locking force provided by the respective piston cylinder means. As soon as the pressure is released in the locking cylinder the walls of the baling box may be opened. It makes no difference how high the internal pressure in the baling box was at the time of opening the box. This type of locking mechanism avoids any jamming as has been the case with other mechanical locking mechanisms of the prior art.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
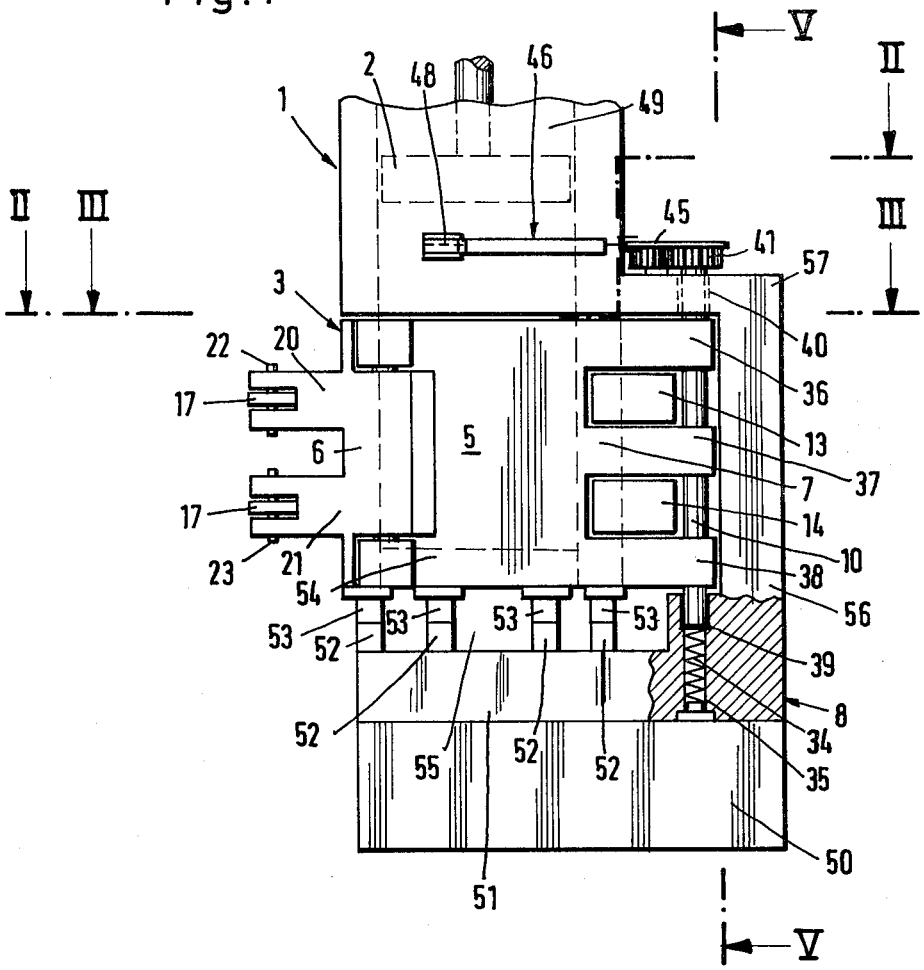
FIG. 1 is a somewhat simplified side view of a baling press according to the invention.

FIG. 1 shows a side elevational view of a baling press according to the invention for producing bales of fibers such as textile fibers. The baling press 1 comprises at least one baling ram 2 and a baling box 3 having box wall members 4, 5 and 6 as well as 7. These box wall members are hinged to a base or frame support structure 8 or to each other. Additionally, the wall members are lockable to one another in the box closing position. The upper end of the press as well as the drive means for the baling ram 2 are not shown in FIG. 1, because these components are not part of the invention.

Figure 2:
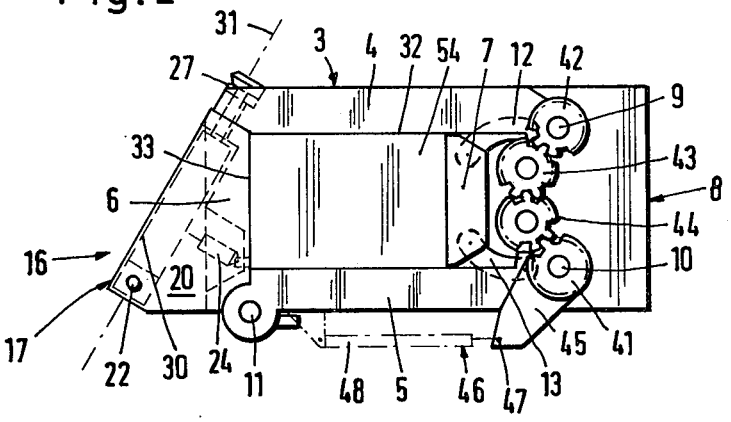
FIG. 2 is a top plan view in a plane defined by the line II—II in FIG. 1, whereby the top portion of the press has been removed, and whereby the baling box is shown in the locked position.
Figure 3:
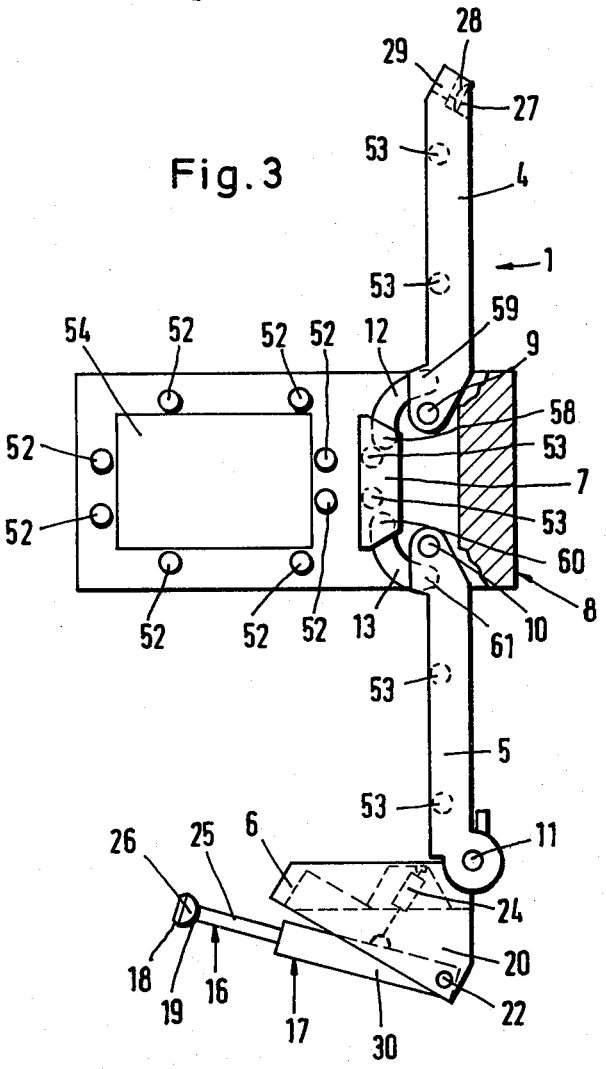
FIG. 3 is a top plan view partially in section, along section line III—III in FIG. 1, and showing the baling box in an open position.

The two wall members 4 and 5 which are arranged opposite each other in the box closing position are tiltable toward and away from each other about the hinging axes 9 and 10 operatively supported in or on the base 8. The wall member 6 may be hinged to one of the walls 4 or 5. As shown, the wall 6 is hinged to the wall 5 by hinging means 11. The further wall member 7 is hinged by means of hinging rods 12, 13, 14 and 15 to the two first mentioned wall members 4 and 5 as best seen in FIGS. 2 and 3. Thus, when the two walls 4 and 5 are moved out of the box closing position shown in FIG. 2, the open box position shown in FIG. 3, the wall member 7 is moved a small distance perpendicularly to its own plane in the outward direction as may be seen by comparing FIGS. 2 and 3. The outward position then extends in parallel to the plane of the wall member 7. The hinging rods 12 to 15 of the wall member 7 extend somewhat in a curved or arcuate manner as shown in FIGS. 2 and 3.

Figure 4:
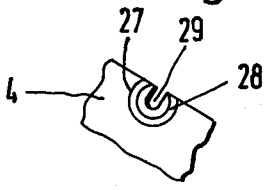
FIG. 4 shows a plan view detail of the second locking means of the locking mechanism according to the invention on a somewhat enlarged scale relative to the other figures.
Figure 5:
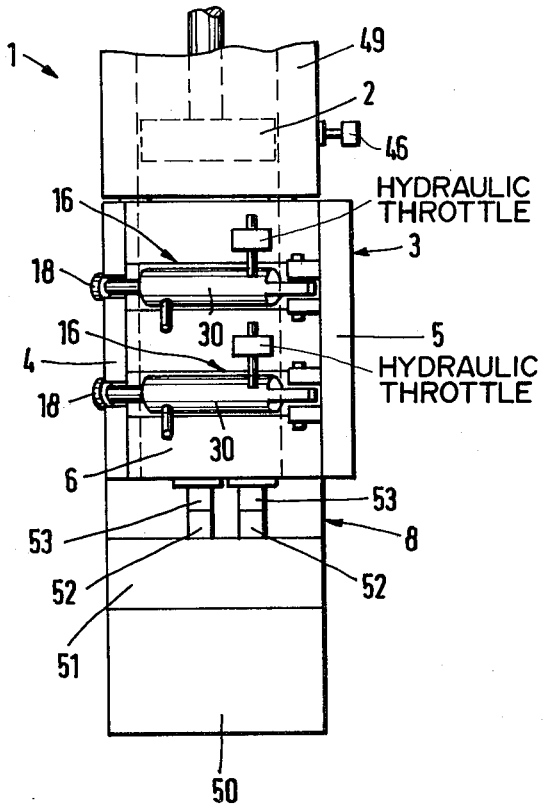
FIG. 5 is a front elevational view of the baling press shown in FIG. 1.
Figure 6:
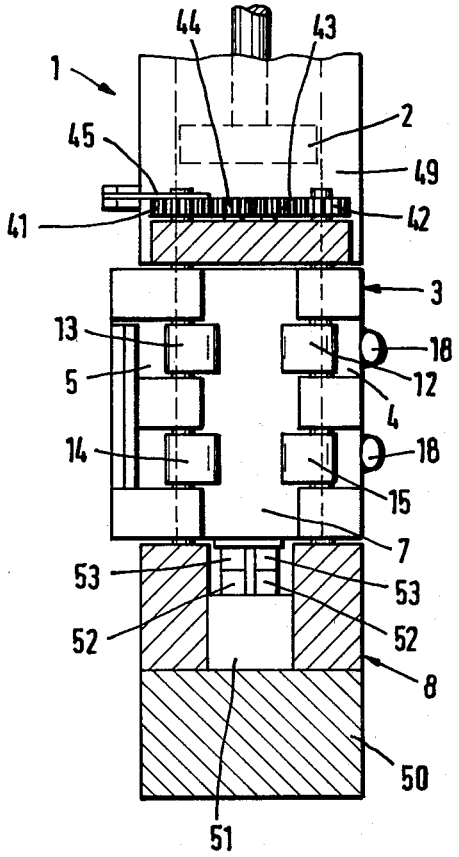
FIG. 6 is a sectional view along section line VI—VI in FIG. 1.

The wall 6 is hingedly supported for movement relative to the wall 5 by only a few degrees. In the shown example, the locking mechanism 16 is journalled by journal means 22 and 23 to brackets 20 and 21 which in turn are secured to the wall 6. The locking mechanism 16 comprises a piston cylinder arrangement 17 journalled to the wall 6 as just described and tiltable with the wall 6 about the journal means 11 relative to the wall 5. Two piston cylinder locking mechanisms may be provided as best seen in FIG. 5. Each locking mechanism is equipped at the free end 19 of its piston rod 25 with a first locking means 18 for cooperation with second locking means shown in FIG. 4. The position of the locking piston cylinder means is adjustable by adjustment piston cylinders 24 between the open position shown in FIG. 3, and the closed position shown in FIG. 2. The first locking means 18 may, for example, comprise a ball or hemispherical member having a diameter larger than the diameter of the piston rod 25. The ball or hemisphere 18 has a curved surface 26 forming a locking surface cooperating with the second holding means 27 forming part of or secured to the wall 4 in the form of a calotte type recess with a holding surface 28 and an entrance slot 29 having a width permitting the entry of the piston rod 25 as shown in FIGS. 3 and 4.

For locking the baling box 3, the piston rod 25 enters into the slot 29 whereupon the piston is moved inside the locking cylinder 30 of the locking piston cylinder device 17. Thus, the first locking means 18 come to rest in or on the calotte type recess surface 28 of the second locking means 27, thereby securely locking the baling box in a force transmitting manner.

For opening the baling box 3, the closing pressure in the locking cylinder 30 is initially reduced, for example by a hydraulic throttle valve provided in the hydraulic supply conduits to the two locking cylinders 30 as shown in FIG. 5. The closing pressure is reduced until the bale in the box 3 does not exert any pressure on the wall members 4, 5, 6 and 7. The operator then moves the piston rod 25 out of the slot 29 until the first locking means 18 completely clear the second locking means 27, whereupon the walls may be tilted outwardly to open the box.

The components of the locking mechanism 16 which has a longitudinal axis 31 shown in FIG. 2 are so arranged that this axis 31 extends at a slanting angle relative to the planes 32 and 33 of the two walls 4 and 6 when the latter are locked to each other in the locking position of the mechanism 16.

Except for the throttling valve means shown in FIG. 5, the other control mechanisms and hydraulic power supply conduits for the several piston cylinder means are not shown in the figures in order to keep the figures simple. Besides, such hydraulic control means are well known in the art.

As seen especially in FIG. 1, each of the two hinging axes 9 and 10 of the walls 4 and 5 are supported by spring means 34 located in a bore 35 of the base or support frame 8. The walls 4 or 5 are preferably rigidly secured to the hinging axes 9 and 10 respectively, whereby these wall members 4 and 5 are urged or biased vertically upwardly by the springs 34. Conversely, the walls 4 or 5 are supported by these rather stiff or strong springs 34. The rigid connection of the wall members 4 and 5 with the respective hinging axes 9 and 10 may be accomplished by bracket members 36, 37 and 38, whereby these axes 9 and 10 are held in lower guide bearings 39 and upper guide bearings 40. The upper ends of the axes 9 and 10 extend somewhat out of the guide bearings 40. Meshing gear wheels 41 and 42 are secured to these upper ends of the hinging axes 9 and 10 for meshing cooperation with intermediate gear wheels 43 and 44 arranged so that the wall members move in opposite rotational or hinging directions. A tilting lever 45 is operatively secured to one of the gear wheels 41 for adjustment of the position of the respective box wall member by means of a further piston cylinder device 46 connected with its one end 47 to the tilting lever 45 and with its other end 48 to an upper box portion 49 of the baling press 1. As soon as the piston cylinder device 46 tilts the tilting lever 45 in one or the other direction, the two walls 4 and 5 are opened or closed in a synchroneous manner.

The support frame or base 8 comprises a substantially U or yoke-shape and includes a base plate 50 as well as a bearing plate 51 supporting a spacer member 55 and a fifth wall member 54 or bottom 54. A plurality of pressure take-up members 52 are arranged for each vertical box wall member 4, 5, 6 and 7. Preferably two pressure take-up members 52 are provided for each vertical wall member as best seen in FIG. 3. The vertical wall members rest on these pressure take-up members 52 with cooperating members 53 as best seen in FIG. 1. The pressure take-up members 53 rest on the lower pressure take-up members 52 when the baling ram 2 is moved downwardly into the baling box 3. However, as soon as the locking mechanism 16 has been opened, the springs 34 bearing on the journal axes 9 and 10 lift the walls 4 and 5 and thus also the walls 6 and 7 to such an extent upwardly that the lower and upper pressure take-up members 52, 53 do not touch each other, thereby facilitating the opening of these box wall members 4, 5, 6 and 7. The springs 34 thus constitute a lifting mechanism which makes sure that the wall members 4 to 7 can be opened and closed substantially in a contact-free manner, thereby avoiding any jamming.

The baling ram 2 presses inside the box 3 against the fifth bottom wall 54 which is rigidly supported by the base 8. However, it is possible to replace the bottom 54 by a second baling ram which would move oppositely to the ram 2. Also, the bottom 54 could be replaced by a substantially stationary counterholder ram or the like. The bottom 54 rests on an intermediate spacer member 55 located inside the pressure take-up members 52, 53 and above the bearing plate 51. In other words, the members 52, 53 surround the spacer member 55.

The U-shaped base frame 8 comprises a carrier member 56 located above the bearing plate 51 or rather above the bottom wall 54 and laterally or rather, behind the journal axes 9 and 10. The upper end 57 of the carrier member 56 extends horizontally away and carries the upper guide bearings 40 for the hinging axes 9 and 10. The upper end 57 further carries the upper box portion 49 and the ram 2.

Incidentally, the hinging rods 12 and 13 are connected to the wall 7 by means of hinging shafts 58 and 60 as best seen in FIG. 3. The hinging rod 12 is also hinged to the wall 4 by a hinging shaft 59. The hinging rod 13 is hinged to the wall 5 by a hinging shaft 61. Structural details, not shown, are apparent from the overall disclosure.

Although the invention has been described with reference to specific example embodiments, it will be appreciated, that it is intended to cover all modifications and equivalents within the scope of the appended claims.

What is claimed is:

1. A baling press for producing bales of fibrous material, comprising baling box means, baling ram means arranged for movement into and out of said baling box means, base means for supporting said baling box means and said baling ram means, said baling box means comprising a plurality of individual box wall members (4, 5, 6, 7), hinging means operatively hinging said box wall members for movement between a box forming closed position and an open position, locking piston cylinder means (16, 17, 30) including at least one piston rod (25) and first locking means (18) at the free end of the piston rod (25), journal means (22) operatively securing said locking piston cylinder means (30) to one of said box wall members (6), and second locking means (27) on another box wall member (4) arranged for cooperation with said first locking means (18) for power holding the box walls in a closed baling position, wherein said locking piston cylinder means has a longitudinal axis, said locking piston cylinder means being so positioned on said one box wall member (6) that said longitudinal axis extends at an angle in an angular position relative to said one (6) and to said other (4) box wall members when they are locked to each other by said locking means, whereby three of said box wall members are held together in a force locking manner.

2. The baling press of claim 1, wherein said first locking means comprise a locking member rigidly secured to the free end of said locking piston rod, said second locking means comprising a locking element shaped for cooperation with said locking member at the free end of the piston rod, said locking member having an approximately hemispherically shaped surface facing the piston rod, said hemispherically shaped surface having a diameter larger than the diameter of said piston rod, said locking element having a recess shaped as an approximately hemispherical cup for cooperation with said hemispherically shaped surface of said locking member for accommodating said angular position of said locking piston cylinder means.

3. The baling press of claim 1, wherein said journal means operatively secures said locking piston cylinder means to one of said box wall members which itself is hinged by said hinging means to another one of said box wall members.

4. The baling press of claim 1, further comprising adjustment piston cylinder means (24) operatively connected to said locking piston cylinder means for adjusting the position of said locking piston cylinder means relative to said second locking means.

5. The baling press of claim 1, further comprising hydraulic supply conduit means operatively connected to said locking piston cylinder means, and adjustable throttle valve means connected in said supply conduit means.

6. The baling press of claim 1, wherein said hinging means comprise hinging members (9, 10) for hinging two of said plurality of box wall members (4, 5) to said base means for movement toward and away from each other and for locating these two box wall members opposite each other in the box closing position, said press further comprising meshing gear wheels (41, 42, 43, 44) operatively interconnecting said two box wall members which are hinged to said base means.

7. The baling press of claim 6, further comprising tilting lever means (45) operatively connected to one of said gear wheels, and wall moving piston cylinder means operatively connected to said tilting lever means for moving said two box wall members.

8. The baling press of claim 6, further comprising spring means (34) operatively arranged between said base means and said two wall members hinged to said base means for biasing said two wall members in a substantially vertically upward direction.

9. The baling press of claim 1, further comprising pressure take-up support elements, said box wall members including four vertically extending box wall members (4, 5, 6, 7), said support elements being operatively interposed between said vertically extending box wall members and said base means.

10. The baling press of claim 1, wherein said one box wall member (6) to which said locking piston cylinder means is journalled by said journal means (22), is hinged to that box wall member which is located opposite said other box wall member carrying said second locking means for said force locking.

11. A baling press for producing bales of fibrous material, comprising baling box means, baling ram means arranged for movement into and out of said baling box means, base means for supporting said baling box means and said baling ram means, said baling box means comprising five individual box wall members, locking means for locking said box wall members into a box closing position, first hinging means (9, 10) for hinging two box wall members (4, 5) to said base means (8) for movement toward and away from each other and for locating these two wall members opposite each other in the box closing position, second hinging means (12, 13, 14, 15) for hinging a third box wall member (7) to said first mentioned two box wall members (4, 5), third hinging means (11) for hinging a fourth box wall member (6) to one of said two first mentioned box wall members (4, 5), wherein a fifth wall member forming a box bottom is supported by said base means, and wherein said locking means comprise locking piston cylinder means having a longitudinal axis, said locking piston cylinder means being so positioned that said longitudinal axis extends at an angle relative to at least two of said box wall members when they are locked to each other by said first and second locking means, whereby three of said box wall members are held together in a force locking manner.

12. The baling press of claim 11, wherein said locking piston cylinder means comprise first locking means, said press further comprising second locking means arranged for cooperation with said first locking means, and adjustment piston cylinder means (24) operatively connected to said locking piston cylinder means for adjusting the position of said first locking means of said locking piston cylinder means relative to said second locking means.

13. The baling press of claim 12, further comprising hydraulic supply conduit means operatively connected to said locking piston cylinder means, and adjustable throttle valve means connected in said supply conduit means.

14. The baling press of claim 11, further comprising meshing gear wheels (41, 42, 43, 44) operatively interconnecting said two box wall members (4, 5) which are hinged to said base means.

15. The baling press of claim 14, further comprising a tilting lever means (45) operatively connected to one of said gear wheels, and wall moving piston cylinder means operatively connected to said tilting lever means for moving said two box wall members.

16. The baling press of claim 11, further comprising spring means (34) operatively arranged between said base means and said two wall members hinged to said base means for biasing said two wall members in a substantially vertically upward direction.

17. The baling press of claim 11, further comprising pressure take-up support elements, said box wall members including four vertically extending box wall members (4, 5, 6, 7), said support elements being operatively interposed between said vertically extending box wall members and said base means.

18. The baling press of claim 11, further comprising journal means (22) journalling said locking piston cylinder means to said fourth box wall member (6) which is hinged to one of said two box wall members located opposite each other for said force locking.

* * * * *